US010279875B2

(12) United States Patent
Yeh

(10) Patent No.: US 10,279,875 B2
(45) Date of Patent: May 7, 2019

(54) SURFBOARD STRUCTURE WITH FIN ASSEMBLY

(71) Applicant: AGIT Global IP Holdings, LLC, Irvine, CA (US)

(72) Inventor: Tzong In Yeh, Fremont, CA (US)

(73) Assignee: AGIT GLOBAL IP HOLDINGS, LLC, Irvine, CA (US)

( * ) Notice: Subject to any disclaimer, the term of this patent is extended or adjusted under 35 U.S.C. 154(b) by 0 days.

(21) Appl. No.: 15/902,423

(22) Filed: Feb. 22, 2018

(65) Prior Publication Data

US 2019/0071155 A1 Mar. 7, 2019

(30) Foreign Application Priority Data

Sep. 7, 2017 (TW) ..... 106130572 A

(51) Int. Cl.
*B63B 1/00* (2006.01)
*B63B 35/00* (2006.01)
*B63B 35/79* (2006.01)

(52) U.S. Cl.
CPC ..... *B63B 35/793* (2013.01)

(58) Field of Classification Search
CPC ... B63B 35/79; B63B 35/7926; B63B 35/793; B63B 2035/79; B63B 2035/7903
USPC ..... 441/65, 68, 74, 79
See application file for complete search history.

(56) References Cited

U.S. PATENT DOCUMENTS 4,398,485 A * 8/1983 Diziere ..... B63B 35/793 114/132
4,701,144 A * 10/1987 DeWitt, III ..... B63B 35/793 114/132
4,846,745 A 7/1989 Lobe
4,964,826 A * 10/1990 Lobe ..... B63B 35/793 114/132
5,133,681 A * 7/1992 Lobe ..... B63B 35/793 114/127
6,068,531 A * 5/2000 Patterson ..... B63B 35/793 441/74
6,752,674 B2 * 6/2004 Jolly ..... B63B 35/793 114/140
6,837,763 B1 * 1/2005 Masteller ..... B63B 35/793 441/79
RE38,840 E * 10/2005 Patterson ..... 441/74
7,285,031 B2 * 10/2007 Mair ..... B63B 35/793 114/140
9,688,365 B2 * 6/2017 Norrie ..... B63B 35/7926
9,908,596 B2 * 3/2018 Watson ..... B63B 35/793
(Continued)

*Primary Examiner* — Daniel V Venne
(74) *Attorney, Agent, or Firm* — Muncy, Geissler, Olds & Lowe, P.C.

(57) ABSTRACT

A fin assembly includes a fin body and a fin holder. The fin holder has an elongated channel, a pair of opposing slots, a pair of front guiding grooves and a pair of rear guiding grooves. The pair of front guiding grooves are defined in the opposing sidewalls of a front section of the elongated channel at a horizontal level, and misaligned with a bottom of the elongated channel. The pair of rear guiding grooves are defined in the opposing sidewalls of a rear section of the elongated channel above the horizontal level, and are flush with the bottom of the elongated channel Besides, the fin holder defines in its rear wall a horizontal hole with a cross section large enough to cover a space between the pair of rear guiding grooves.

7 Claims, 6 Drawing Sheets

(56) References Cited

U.S. PATENT DOCUMENTS 9,926,051 B2 * 3/2018 Miller ..... B63B 35/793
9,957,021 B2 * 5/2018 Scott ..... B63B 35/793

* cited by examiner

SURFBOARD STRUCTURE WITH FIN ASSEMBLY

BACKGROUND OF THE INVENTION

1. Field of the Invention

The present invention relates to a surfboard structure, and more particularly to a surfboard structure with a fin assembly.

2. Description of the Related Art

One type of fin assembly is illustrated in U.S. Pat. No. 4,846,745. In this fin assembly, the fin body has a base member defining a vertical hole in a front end thereof for receiving a bolt, and a positioning pin is transversely mounted on a rear end of the base member of the fin body. The fin holder has an elongated channel oriented in a longitudinal direction, and a pair of opposing slots arranged in a transverse direction. The elongated channel is provided to receive the base member of the fin body and allow movement of the base member to desired positions along the length of the fin holder. The pair of opposing slots extend a depth into a bottom surface of the fin holder to a horizontal level. The fin holder further includes a pair of front guiding grooves and a pair of rear guiding grooves. The pair of front guiding grooves is defined in opposing side walls of a front section of the elongated channel and intersected with the pair of opposing slots. Likewise, the pair of rear guiding grooves is defined in opposing side walls of a rear section of the elongated channel and intersected with the pair of opposing slots. The retainer plate has its opposite edges engaged in the pair of the front guiding grooves. The bolt runs through the vertical hole in the base member of the fin body and the vertical hole in the retainer plate to securely hold the front end of the base member of the fin body onto the fin holder. In addition, the positioning pin has its opposite ends engaged in the pair of rear guiding grooves to securely hold the rear end of the base member of the fin body onto the fin holder.

SUMMARY OF THE INVENTION

The present invention to provide a new surfboard structure, generally comprising a surfboard and a fin assembly mounted underneath the surfboard.

Specifically, the fin assembly includes a fin body, a fin holder, a retainer plate and a bolt. The fin body has a base member defining a vertical hole at a first end thereof. The fin holder defines therein an elongated channel, a pair of opposing slots, a pair of front guiding grooves and a pair of rear guiding grooves. The elongated channel is defined in a bottom surface of the fin holder to receive the base member of the fin body. The pair of opposing slots is defined in opposing sidewalls of a middle section of the elongated channel and extends a depth into the bottom surface of the fin holder to a horizontal level. The pair of front guiding grooves is defined in opposing sidewalls of a front section of the elongated channel and intersected with the pair of opposing slots. The pair of rear guiding grooves is defined in opposing sidewalls of a rear section of the elongated channel and intersected with the pair of opposing slots. The retainer plate has a vertical hole, and is disposed in the fin holder with two opposite edges engaged in either one of the pair of front guiding grooves and the pair of rear guiding grooves. The bolt passes through the vertical hole in the base member of the fin body and the vertical hole in the retainer plate to securely hold the first end of the base member of the fin body in the fin holder.

Furthermore, the fin holder has an entrance defined in between the pair of opposing slots to allow entry of the retainer plate into the fin holder. The entrance has a first side edge and a second side edge. The first side edge extends along a longitudinal direction of the fin holder, and is longer than a thickness of the retainer plate. The second side edge extends along a lateral direction of the fin holder and is slightly longer than a width of the retainer plate. The pair of front guiding grooves is defined in the opposing sidewalls of the front section of the elongated channel at the horizontal level, and misaligned with a channel bottom of the elongated channel. The pair of rear guiding grooves is defined in the opposing sidewalls of the rear section of the elongated channel above the horizontal level, and is arranged flush with the channel bottom of the elongated channel Besides, the fin holder further has a first, horizontal hole defined in a rear wall thereof. The first horizontal hole is in communication with the elongated channel and the outside of the fin holder, and has a cross section large enough to cover a space between the pair of the rear guiding grooves.

Preferably, the fin holder further includes a second, horizontal hole defined in a front wall thereof and in communication with the elongated channel and the outside of the fin holder, and the second horizontal hole has a cross section large enough to cover a space between the pair of the front guiding grooves.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
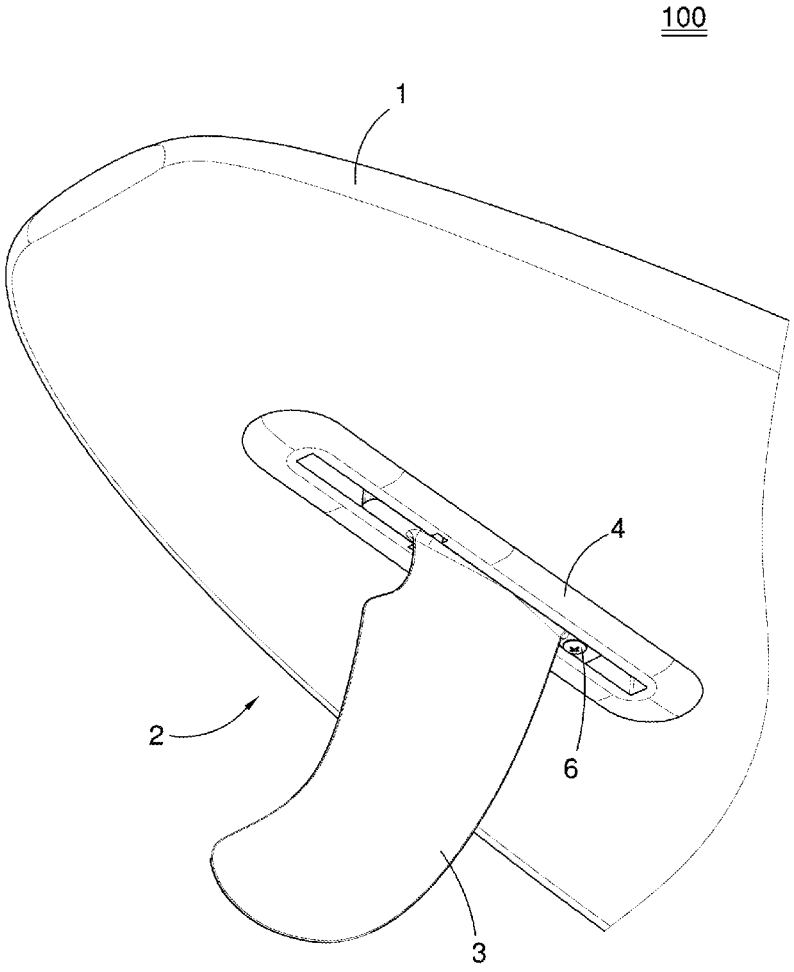
FIG. 1 is a partially perspective view of a surfboard structure with a fin assembly in accordance with the preferred embodiment of the present invention.
Figure 2:
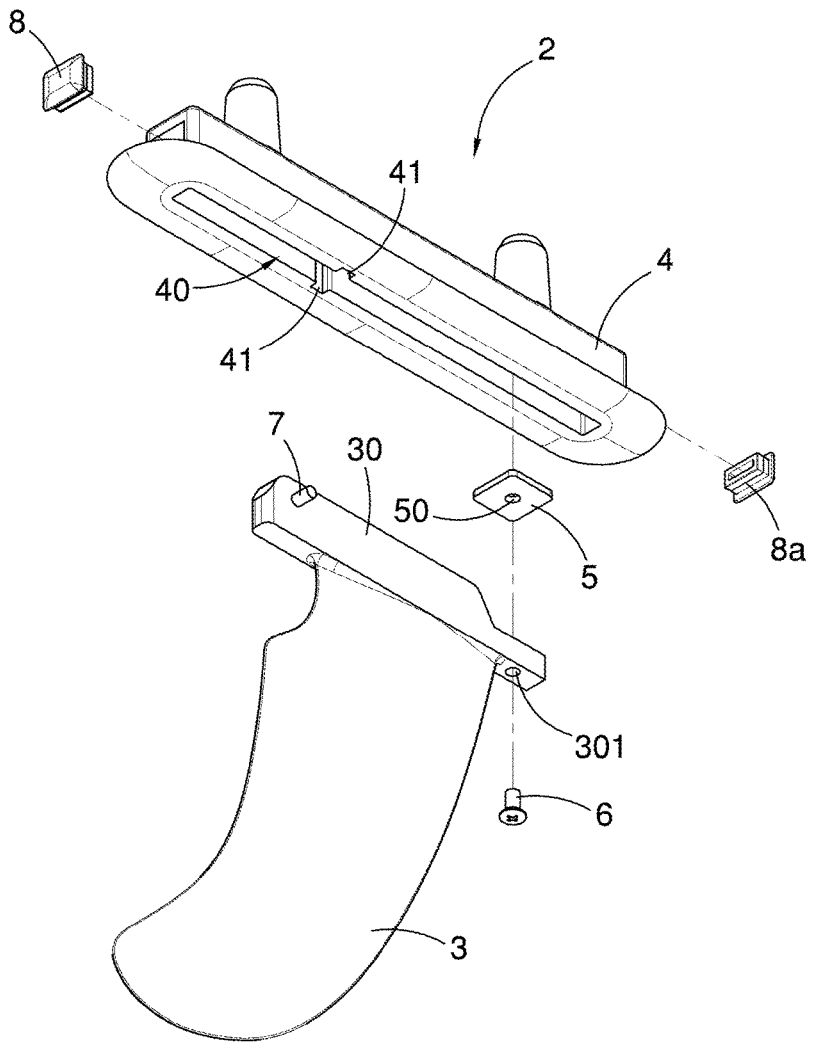
FIG. 2 is an exploded perspective view of the fin assembly of the surfboard structure shown in FIG. 1.

Referring now to the drawing, there is shown a preferred embodiment of the surfboard structure 100. As shown in FIG. 1, the surfboard structure 100 includes a surfboard 1 and a fin assembly 2 mounted underneath the surfboard 1. As shown in FIG. 2, the fin assembly 2 generally includes a fin body 3, a fin holder 4, a set of a retainer plate 5 and a bolt 6 for securely holding a first end of a base member 30 of the fin body 3 in the fin holder 4, and a positioning pin 7 for securely holding a second, opposite end of the base member 30 of the fin body 3 in the fin holder 4.

Specifically, the base member 30 of the fin body 3 has a vertical hole 301 defined in the front end thereof. The positioning pin 7 extends through the rear end of the base member 30 of the fin body 3. The fin holder 4 has an elongated channel 40 longitudinally defined in a bottom surface of the fin holder 4 to receive the base member 30 of the fin body 3. The base member 30 of the fin body 3 may slide longitudinally in the elongated channel 40 of the fin holder 4 until the desired positioning of the fin body 3 is established. The fin holder 4 further has a pair of opposing slots 41 transversely defined in opposing sidewalls of a middle section of the elongated channel 40 and extending a depth into the bottom surface of the fin holder 4 to a horizontal level, as depicted in FIG. 5.

Figure 3:
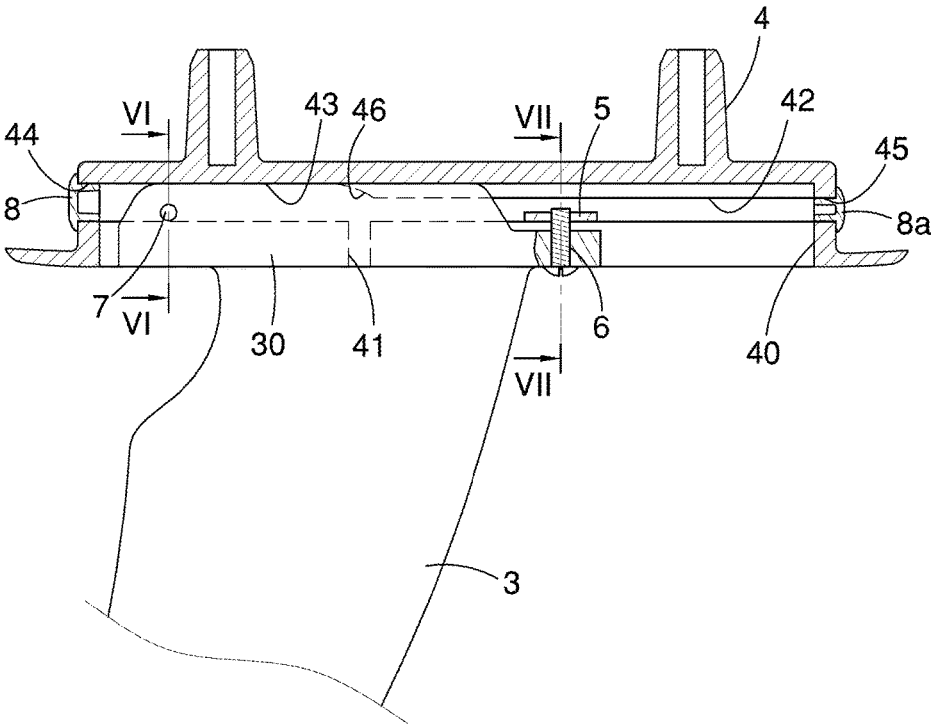
FIG. 3 is a longitudinal cross-sectional view of the fin assembly shown in FIG. 2.
Figure 4:
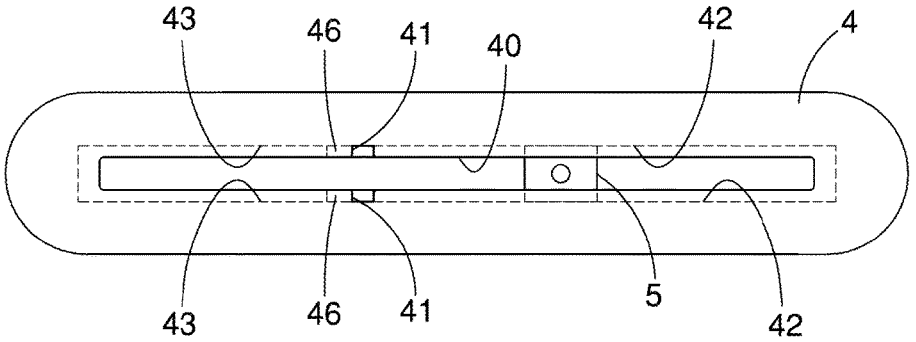
FIG. 4 is a bottom plan view of a fin holder of the fin assembly shown in FIG. 3.

Referring to FIGS. 3 and 4, the fin holder 4 further has a pair of front guiding grooves 42 and a pair of rear guiding grooves 43. The pair of front guiding grooves 42 is defined in opposing sidewalls of a front section of the elongated channel 40 and intersected with the pair of opposing slots 41. Likewise, the pair of rear guiding grooves 43 is defined in opposing sidewalls of a rear section of the elongated channel 40 and intersected with the pair of opposing slots 41.

Figure 6:
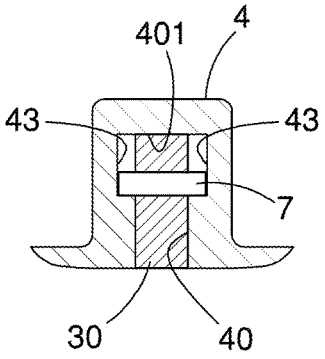
FIG. 6 is a transverse cross-sectional view of the fin assembly, taken along line VI-VI shown in FIG. 3.
Figure 7:
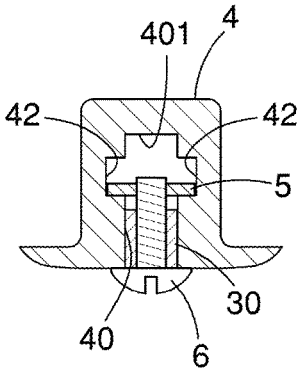
FIG. 7 is another transverse cross-sectional view of the fin assembly, taken along line VII-VII shown in FIG. 3.

Referring to FIGS. 2, 3 and 7, the retainer plate 5 has a vertical hole 50, and is disposed in the fin holder 4 with its two opposite edges engaged in the pair of front guiding grooves 42. The bolt 6 runs through the vertical hole 301 in the base member 30 of the fin body 3 and the vertical hole 50 in the retainer plate 5 to securely hold the front end of the base member 30 of the fin body 3 in the fin holder 4. Referring to FIG. 6, the positioning pin 7 has its two opposite ends engaged in the pair of rear guiding grooves 43 to securely hold the rear end of the base member 30 of the fin body 3 in the fin holder 4. It should be understood, however, that in other examples, the positioning pin 7 may be arranged in the front end of the base member 30 of the fin body 3 while the retaining plate 5 arranged in the rear end for the same purpose. It is also noted that, in this preferred embodiment, the pair of front guiding grooves 42 has a length greater than that of the pair of rear guiding grooves 43. When the base member 30 of the fin body 3 is adjusted to have its rear end abutting against a rear wall of the elongated channel 40, the vertical hole 301 in the front end of the base member 30 remains located within the length of the pair of front guiding grooves 42. That is to say, no matter where the base member 30 of the fin body 3 is positioned within the elongated channel 40, the front end of the base member 30 can still be secured by using the retainer plate 5 and the bolt 6.

Figure 5:
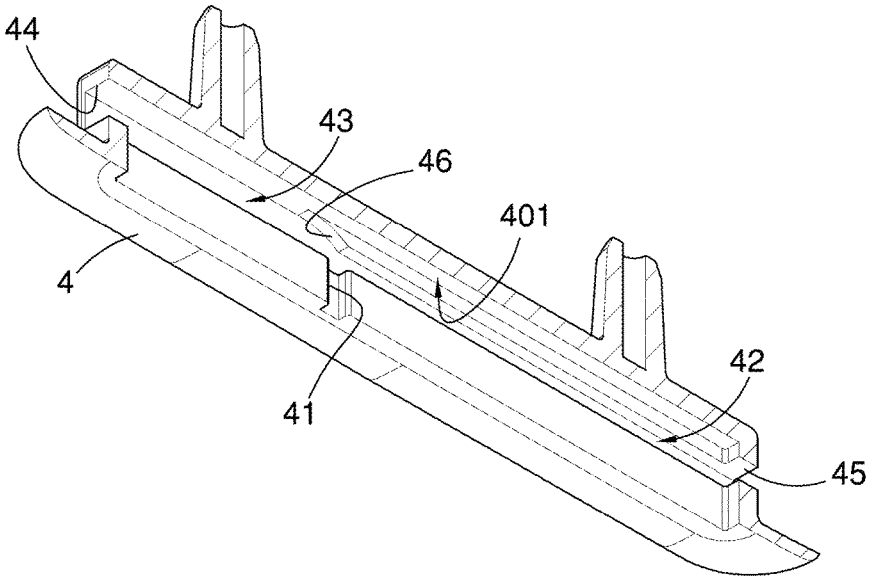
FIG. 5 is a perspective view of the fin holder shown in FIG. 4, partially cut-away to show the interior of the fin holder.

Referring to FIGS. 5 and 7, the pair of front guiding grooves 42 is defined in the opposing sidewalls of the front section of the elongated channel 40 at the aforementioned horizontal level, but misaligned with a channel bottom 401 of the elongated channel 40. In such a manner, the front section of the elongated channel 40 and the pair of front guiding grooves 42 together form a longitudinal groove with a cross-shaped cross-section, as depicted in FIG. 7. On the other hand, referring to FIGS. 5 and 6, the pair of rear guiding grooves 43 is defined in the opposing sidewalls of the rear section of the elongated channel 40 above the horizontal level, and arranged flush with the channel bottom 401 of the elongated channel 40. In such a manner, the rear section of the elongated channel 40 and the pair of rear guiding grooves 43 together form a longitudinal groove with a T-shaped cross-section, as depicted in FIG. 6.

Referring back to FIG. 2, the fin holder 4 has an entrance (not numbered) defined in between the pair of opposing slots 41 to allow entry of the retainer plate 5 and the positioning pin 7 into the fin holder 4. It is understood that the front and rear guiding grooves 42, 43 serve to retain the retainer plate 5 and the positioning pin 7 so that they can slide forward and aft, but cannot escape from the fin holder 4 except by way of the entrance. More specifically, the entrance has a first side edge extending along a longitudinal direction of the fin holder 4 and a second side edge extending along a transverse direction of the fin holder 4. The first side edge of the entrance is longer than a thickness of the retainer plate 5 and a diameter of the positioning pin 7, and the second side edge of the entrance is slightly longer than a width of the retainer plate 5. As such, the retainer plate 5 may be vertically fed into the entrance of the fin holder 4 and then turned into engagement with the pair of front guiding grooves 42. Similarly, the positioning pin 7 may also be vertically fed into the entrance of the fin holder 4 and then turned into engagement with the pair of rear guiding grooves 43. Preferably, as shown in FIG. 5, the fin holder 4 further has a pair of ramps 46 arranged in between the pair of front guiding grooves 42 and the pair of rear guiding grooves 43 and corresponding to the opposing slots 41. The pair of ramps 46 is sloped upward from the pair of front guiding grooves 42 to the pair of rear guiding grooves 43 in a manner that the positioning pin 7 may be placed vertically into the entrance and turned smoothly into engagement with the pair of rear guiding grooves 43, and that the retainer plate 5 may be placed in the same way into the pair of rear guiding grooves 43 and then moved backward to be engaged with the front guiding grooves 42.

Figure 8:
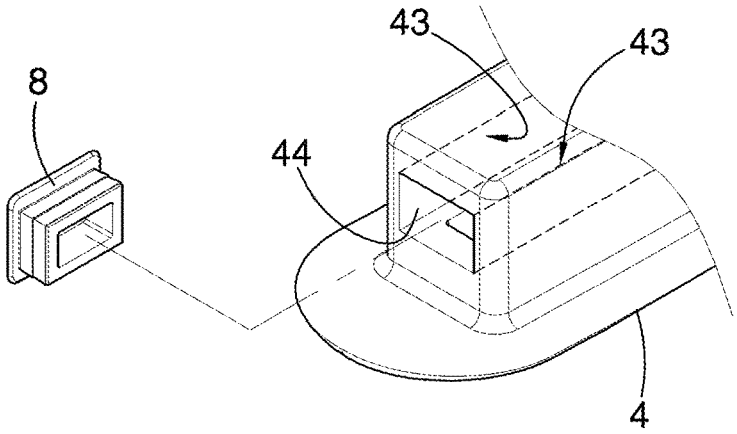
FIG. 8 is a partially exploded perspective view of a rear end of the fin holder shown in FIG. 2.
Figure 9:
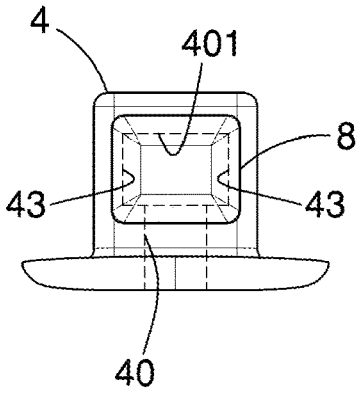
FIG. 9 is a rear end view of the fin holder shown in FIG. 8.
Figure 10:
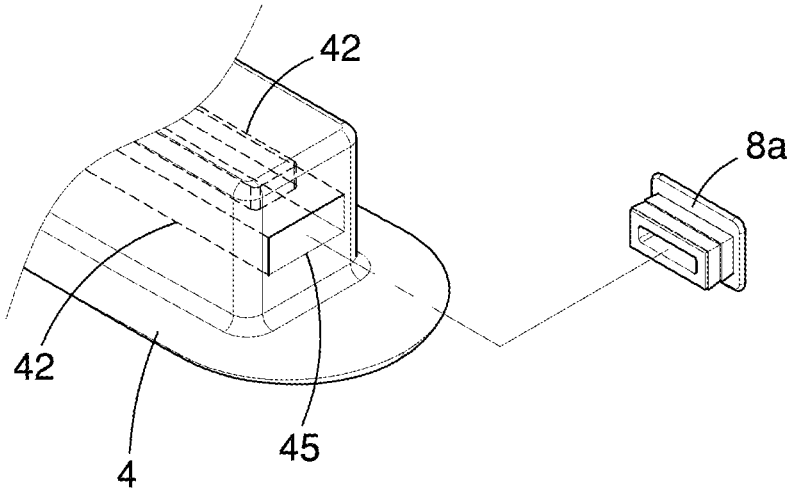
FIG. 10 is a partially exploded perspective view of a front end of the fin holder shown in FIG. 2.
Figure 11:
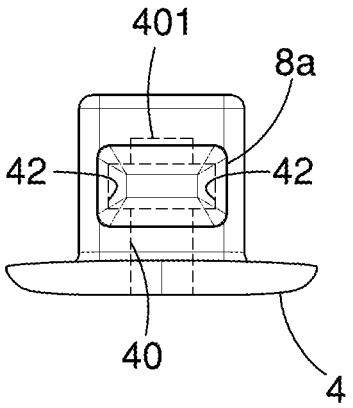
FIG. 11 is a front end view of the fin holder shown in FIG. 10.

Referring to FIGS. 2, 3 and 5, the fin holder 4 further defines in its rear wall a first horizontal hole 44, and in its front wall a second, horizontal hole 45 for communication of the elongated channel 40 with the outside of the fin holder 4. It should be noted that, the first horizontal hole 44 has a cross section large enough to cover a space between the pair of the rear guiding grooves 43, as depicted in FIGS. 8 and 9. Similarly, the second horizontal hole 45 has a cross section large enough to cover a space between the pair of the front guiding grooves 42, as depicted in FIGS. 10 and 11. Preferably, a pair of lids 8 or 8*a* may be employed for covering the first and second horizontal holes 44, 45 of the fin holder 4, as shown in FIGS. 9 and 11.

It should be evident that this disclosure is by way of example and that various changes may be made by adding, modifying or eliminating details without departing from the fair scope of the teaching contained in this disclosure.

What is claimed is:

1. A fin assembly for use on a surfboard, the fin assembly comprising:

a fin body having a base member defining a vertical hole at a first end thereof;

a fin holder including:

an elongated channel defined in a bottom surface of the fin holder to receive the base member of the fin body;

a pair of opposing slots defined in opposing sidewalls of a middle section of the elongated channel and extending a depth into the bottom surface of the fin holder to a horizontal level;

a pair of front guiding grooves defined in opposing sidewalls of a front section of the elongated channel and intersected with the pair of opposing slots; and a pair of rear guiding grooves defined in opposing sidewalls of a rear section of the elongated channel and intersected with the pair of opposing slots;

a retainer plate having a vertical hole and disposed in the fin holder with two opposite edges engaged in either one of the pair of front guiding grooves and the pair of rear guiding grooves; and a bolt passing through the vertical hole in the base member of the fin body and the vertical hole in the retainer plate to securely hold the first end of the base member of the fin body in the fin holder;

wherein the fin holder has an entrance defined in between the pair of opposing slots to allow entry of the retainer plate into the fin holder, and the entrance has a first side edge extending along a longitudinal direction of the fin holder and being longer than a thickness of the retainer plate, and a second side edge extending along a lateral direction of the fin holder and being slightly longer than a width of the retainer plate;

the pair of front guiding grooves being defined in the opposing sidewalls of the front section of the elongated channel at the horizontal level, and misaligned with a channel bottom of the elongated channel;

the pair of rear guiding grooves being defined in the opposing sidewalls of the rear section of the elongated channel above the horizontal level, and arranged flush with the channel bottom of the elongated channel; and the fin holder further having a first, horizontal hole defined in a rear wall thereof, wherein the first horizontal hole is in communication with the elongated channel and an outside of the fin holder, and has a cross section large enough to cover a space between the pair of the rear guiding grooves.

2. The fin assembly as recited in claim 1, wherein the fin holder further includes a second, horizontal hole defined in a front wall thereof and in communication with the elongated channel and the outside of the fin holder, and the second horizontal hole has a cross section large enough to cover a space between the pair of the front guiding grooves.

3. The fin assembly as recited in claim 1, further comprising a positioning pin which transversely passes through a second, opposite end of the base member of the fin body and has two opposite ends engaged in one of the pair of front guiding grooves or the pair of rear guiding grooves to securely hold the second end of the base member of the fin body in the fin holder.

4. The fin assembly as recited in claim 3, wherein the fin holder further has a pair of ramps arranged in between the pair of front guiding grooves and the pair of rear guiding grooves and corresponding to the pair of opposing slots for guiding the positioning pin to slide from the entrance of the fin holder to the pair of rear guiding grooves.

5. The fin assembly as recited in claim 1, wherein the pair of front guiding grooves has a length greater than that of the pair of rear guiding grooves, and when the base member of the fin body is adjusted to have the second end of the base member bearing against a rear wall of the elongated channel, the vertical hole in the second end of the base member remains located within the length of the pair of front guiding grooves.

6. The fin assembly as recited in claim 1, further comprising a lid for covering the first, horizontal hole of the fin holder.

7. A surfboard structure comprising a surfboard and a fin assembly as recited in claim 1, wherein the fin assembly is mounted underneath the surfboard.

* * * * *